United States Patent [19]

Tamura et al.

[11] Patent Number: 4,683,859

[45] Date of Patent: Aug. 4, 1987

[54] APPARATUS FOR INJECTING FUEL INTO INTERNAL COMBUSTION ENGINE

[75] Inventors: Hiroshi Tamura, Oobu; Kazuyoshi Nishibori, Toyoake; Yasutaka Yamauchi, Toyota; Katsushi Kato, Kariya, all of Japan

[73] Assignee: Nippondenso Co., Ltd., Kariya, Japan

[21] Appl. No.: 796,549

[22] Filed: Nov. 8, 1985

[30] Foreign Application Priority Data

Nov. 9, 1984 [JP] Japan ..... 59-237367
Nov. 19, 1984 [JP] Japan ..... 59-245458
Dec. 3, 1984 [JP] Japan ..... 59-255960

[51] Int. Cl.[4] ..... F02D 41/06

[52] U.S. Cl. ..... 123/491; 123/179 L; 123/479; 364/431.1

[58] Field of Search ..... 123/179 L, 491, 479; 364/431.1

[56] References Cited

U.S. PATENT DOCUMENTS 4,171,692 10/1979 Drews et al. ..... 123/491
4,180,020 12/1979 Reddy ..... 123/491
4,198,932 4/1980 Reddy et al. ..... 123/491
4,208,991 6/1980 Reddy ..... 123/491
4,541,390 9/1985 Steinbrenner et al. ..... 123/491
4,587,939 5/1986 Hemminger et al. ..... 123/479

FOREIGN PATENT DOCUMENTS 217737 12/1983 Japan .
222927 12/1983 Japan .
549 1/1984 Japan ..... 123/491

*Primary Examiner*—Tony M. Argenbright
*Attorney, Agent, or Firm*—Cushman, Darby & Cushman

[57] ABSTRACT

In a fuel injection system for an internal combustion engine, the voltage of a vehicle-mounted battery is monitored to see if the voltage is below a predetermined voltage at which a microcomputer used in an electronic control unit is disabled or malfunctions on engine start where large current is consumed by a starter motor. During engine start, asynchronous fuel injection is performed using the result of the voltage monitoring in place of normal or main fuel injection. The amount of fuel to be injected by the asynchronous fuel injection may be limited and/or the number of times of asynchronous fuel injection may be limited so as to prevent excessive fuel supply. In monitoring the battery voltage, hysteresis characteristic may be given to a reference voltage so as to avoid undesirable chattering.

5 Claims, 18 Drawing Figures

APPARATUS FOR INJECTING FUEL INTO INTERNAL COMBUSTION ENGINE

BACKGROUND OF THE INVENTION

This invention relates generally to apparatus for injecting fuel into internal combustion engines, and more particularly to an improvement in fuel supply on engine start with an electronic fuel injection apparatus.

Internal combustion engines mounted on motor vehicles or the like are widely controlled electronically in recent days so that the quantity of fuel to be supplied to an engine is computed by a microcomputer in accordance with operating conditions of the engine. The so called electronic fuel injection (EFI) control unit which controls the opening duration of fuel injection valve(s) is becoming popular. In such an electronic fuel injection control apparatus, the operation of a microcomputer used for comuting the fuel injecting duration has to be normal, but the microcomputer is apt to suffer from undesirable influence caused from voltage fluctuation of the power source.

Especially when an engine starter is operated, the voltage of the power source, i.e. a battery mounted on a motor vehicle, drops to a considerable extent since a large current flows into the starter motor. Therefore, in the case that the battery is deteriorated or in poor condition of low ambient temperature, the voltage of the battery sometimes drops below a value where the operation of the microcomputer cannot be ensured on engine start.

To ensure accurate operation of the microcomputer on engine start irrespective of the dropping of the battery voltage, various measures have hitherto been devised. According to one conventional electronic fuel injection control apparatus, an additional fuel injection valve, which is called start injector, is provided so that fuel is supplied to the engine even if the battery voltage is low. This start injector is provided to an intake pipe and is arranged to be responsive to a time switch using a bimetallic element so that fuel is supplied to the engine for a given period of time on engine start. According to another conventional electronic fuel injection apparatus disclosed in Japanese Patent Provisional Publication No. 58-217737, a backup memory is used for prestoring fuel injection duration suitable for engine start, and when the battery voltage drops below a given voltage, the fuel injection duration from the backup memory is used in place of the results of operation performed by the microcomputer.

However, these conventional techniques suffer from the following problems:

(A) When the above-mentioned start injector is used for supplying fuel on engine start, a separate electrical system and a fuel supply system are necessary in addition to the normal fuel injection system, and thereby the structure of the entire fuel supply system becomes complex. As a result, the reliability of the entire system is apt to be lowered, while the number of manufacturing processes increases resulting in a cost increase. Furthermore, the amount of fuel to be injected is unequivocally determined by the time switch, and therefore, precise control in accordance with starting condition of the engine, such as engine coolant temperature or the number of times of fuel injections, cannot be performed. This also applies to the other method of fuel injection using the backup memory.

(B) Since the starter motor receives a maximum load when one of the cylinders of the engine is in the last part of its compression stroke, the battery voltage drastically fluctuates in correspondence with load variation. Therefore, the battery voltage may fluctuate between a voltage with which the microcomputer can normally operate and another voltage with which the microcomputer cannot normally operate. As a result, the entire microcomputer is reset to an initial state each time the battery voltage drops below a given voltage, and therefore, the microcomputer always starts operating from its initial state whenever the battery voltage is restored. Accordingly, when the battery voltage drops below the given voltage to reset the microcomputer before or in the middle of necessary computation of fuel amount to be injected, accurate fuel amount required for engine start cannot be obtained.

SUMMARY OF THE INVENTION

The present invention has been developed in order to remove the above-described drawbacks inherent to the conventional fuel injection systems.

It is, therefore, an object of the present invention to provide a new and useful fuel injection system with which fuel is securely supplied to engine cylinders on engine start even if the battery voltage fluctuates, without requiring particular start injectors or an additional fuel supply system.

According to a feature of the present invention the voltage of a vehicle-mounted battery is monitored to see if the voltage is below a predetermined value, and an electronic control unit is arranged so as to carry out fuel injection on engine start apart from normal or main fuel injection using the result of monitoring.

In accordance with the present invention there is provided an electronically-controlled fuel injection system for an internal combustion engine, comprising: means for detecting operating conditions of said engine; means for injecting fuel into said engine when activated; means supplied with a supply voltage for controlling said injecting means, said controlling means initiating, during normal operation of said engine, activation of said injecting means in relation to rotational position of said engine and maintaining activation of said injecting means during a time period calculated in accordance with the operating conditions of said engine detected by said detecting means; and means for monitoring the supply voltage and producing first and second outputs indicating that the monitored supply voltage is below and above a predetermined level corresponding to a lowest possible voltage for the operation of said controlling means; said controlling means initiating, during cranking of said engine, activation of said injecting means each time output condition of said monitoring means changes from the first to second output and maintaining activation of said injecting means during a predetermined time period.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
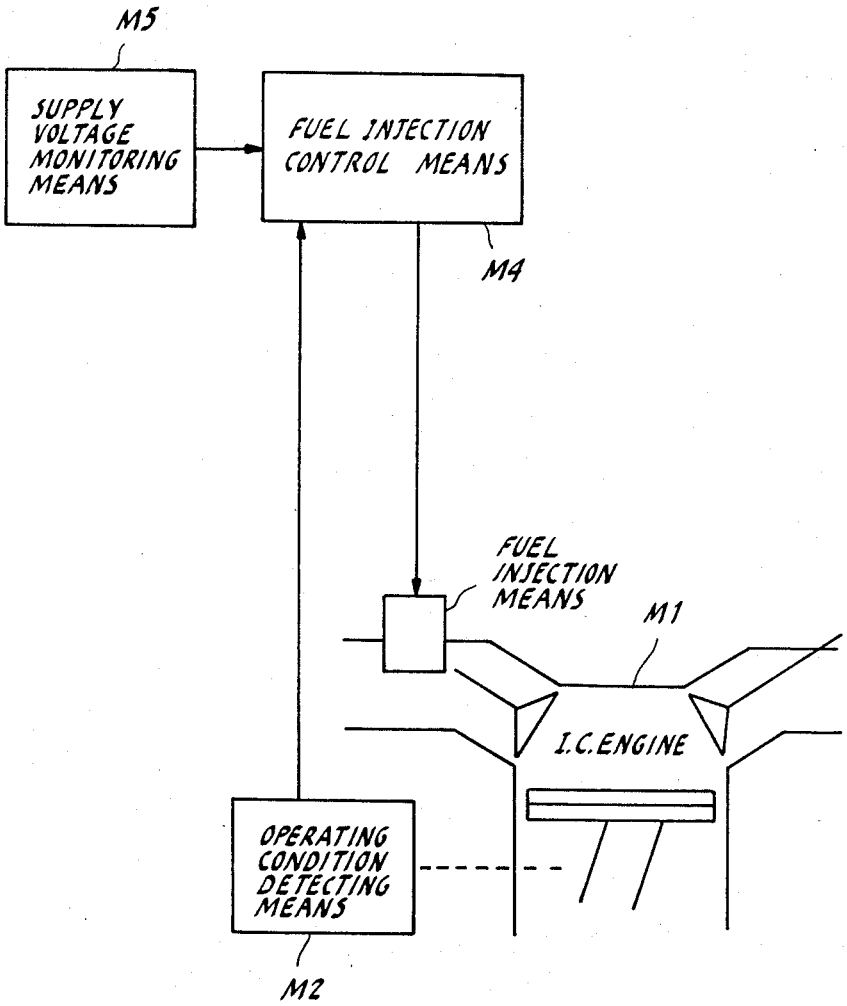
FIG. 1 is a schematic view of an engine control system according to the present invention.

Prior to describing preferred embodiments of the present invention, the general concept of the present invention will be described with reference to FIG. 1. In FIG. 1, an internal combustion engine to be controlled is designated at the reference M1, and a fuel injection control means by the reference M4. The reference M3 is fuel injection means responsive to the fuel injection control means M4, and the reference M2 indicates operating condition detecting means which detects the operating condition of the engine M1. Power supply voltage monitoring means M5 is provided for detecting and monitoring the voltage of an unshown vehicle-mounted battery to supply the result of monitoring to the fuel injection control means M4.

The operating condition detecting means M2 is used for detecting various operating conditions of the engine M1, such as the rotational speed Ne, coolant temperature Thw, intake air quantity Q, intake air temperature Ta or the like. Some of these parameters which are necessary for controlling the internal combustion engine M2 may be used.

The fuel injection control means M4 comprises a well known microcomputer having one or several IC chips. More specifically, the microcomputer includes a central processing unit (CPU), memories with a RAM and a ROM, analog and digital input output ports, a timer, a couter and so on. The fuel injection control means M4 computes amount of fuel to be injected on the basis of operating condition(s) of the engine M1 detected by the operating condition detecting means M2 so as to control the amount of fuel supplied with electromagnetic fuel injection valve(s) being opened and closed.

The power source voltage monitoring means M5 is used for watching the power source voltage fed to the fuel injection control means M4, and is arranged to detect a given voltage which is higher than a voltage at which the fuel injection control means M4 is disabled, with which given voltage the operation of the fuel injection control means M4 is ensured, and another given voltage with which the resumption of the operation of the microcomputer is ensured.

In the electronic fuel injection control apparatus according to the present invention, the power source voltage monitoring means M5 detects whether the power source voltage is above the above-mentioned given voltage where the fuel injection control means M4 is capable of performing normal operation, and each time the battery voltage, rises beyond the given voltage asynchronous injection of a given amount of fuel is performed by the fuel injection control means M4.

The term "asynchronous fuel injection" throughout this specification refers to fuel injection which is not necessarily synchronized with engine rotation. On the other hand, normal fuel injection, performed during usual operation of the engine, is referred to as normal or main fuel injection. In the above-mentioned control, it is preferable that a given hysterisis characteristic is given to the given voltage where the normal operation of the microcomputer is ensured since undesirable chattering around the given voltage can be effectively prevented. Similarly, it is also preferable that the asynchronous fuel injection is performed from an instant where a predetermined delay time has elapsed from the instant of the power source voltage restoration. In addition, it is also preferable that the amount of fuel to be injected by a single asynchronous injection is determined on the basis of the coolant temperature, since engine start characteristic can be enhanced in this way.

Figure 2:
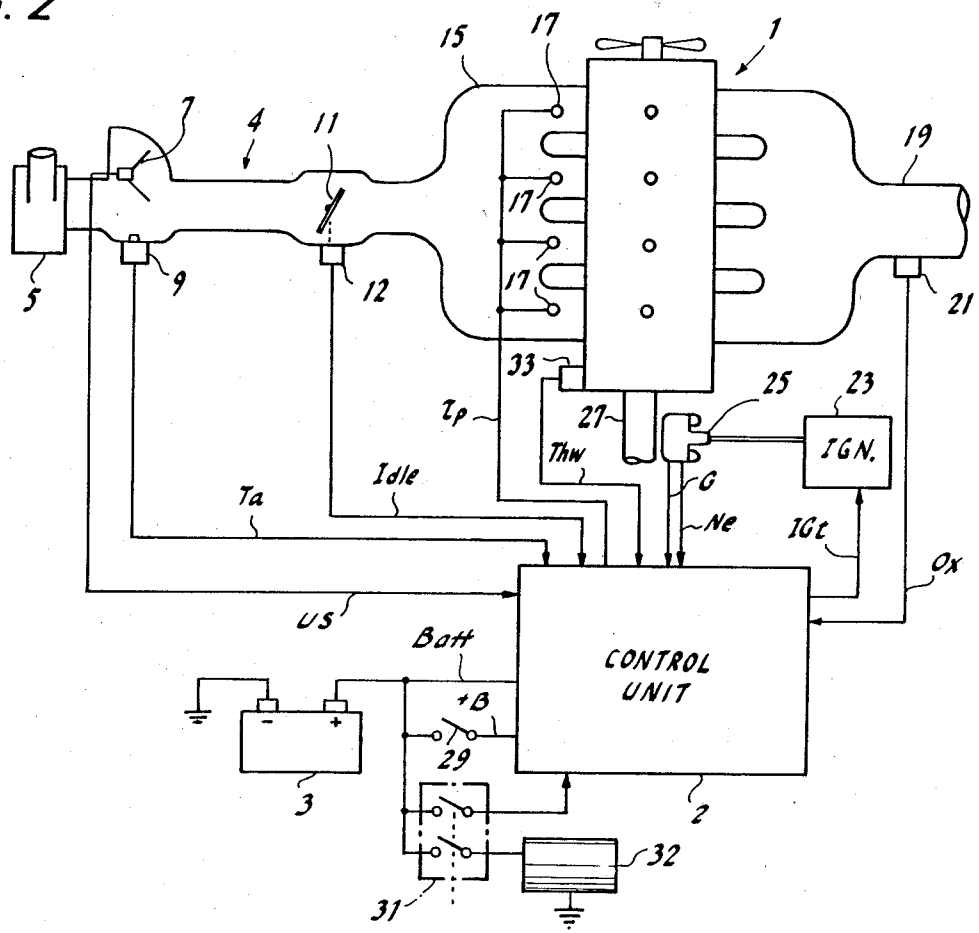
FIG. 2 illustrates the engine control system of FIG. 1 showing an engine to be controlled and peripheral elements.

Referring now to FIG. 2 a first embodiment of the present invention will be described. In FIG. 2, the reference 1 is an internal combustion engine corresponding to M1 of FIG. 1, with a four-cycle four-cylinder engine 1 being illustrated as an example. The reference 2 is an electronic control unit corresponding to the fuel injection control means M4. The reference 3 is a vehicle-mounted battery used for supplying electrical power to various electrical and electronic equipment of a motor vehicle (not shown). To an intake pipe of the engine 1 are provided air cleaner 5, airflow meter 7, intake air temperature sensor 9, throttle valve 11, idle switch 12 in a direction from the upstream portion toward the downstream portion so that intake air is sucked into unshown engine cylinders as air-fuel mixture after being mixed with fuel which is injected through electromagnetic fuel injection valves 17 provided to an intake manifold 15 An oxygen sensor 21 is provided to an exhaust pipe 19 of the engine 1 for detecting the concentration of oxygen contained in exhaust gasses.

The reference 23 is an igniter, and the reference 25 is a distributer which distributes high voltage generated by the igniter 23 to unshown respective spark plugs in synchronizm with the rotation of engine crankshaft 27. The distributer 25 is arranged to generate cylinder-determination signal G1 and engine speed signal Ne.

The reference 29 is an ignition switch which connects the battery 3 to the electronic control unit 2, the reference 31 being a starter switch gang-controlled by the ignition switch 29 for turning on a starter motor 32, and the reference 33 being a coolant temperature sensor detecting the temperature of engine coolant.

Figure 3:
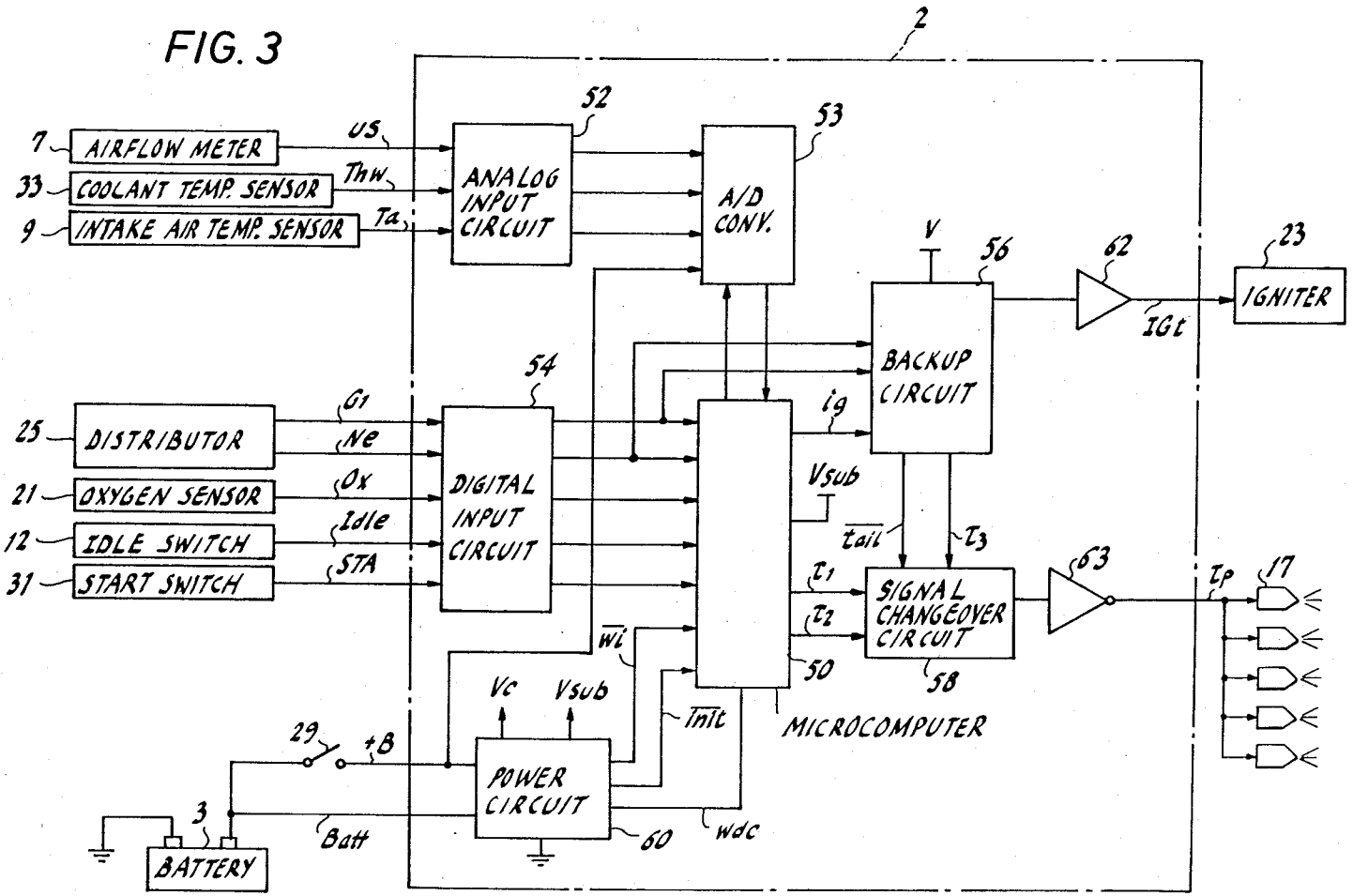
FIG. 3 is a block diagram of an electronic control unit used in the system of FIGS. 1 and 2.

The electronic control unit 2 comprises, as shown in FIG. 3, a microcomputer 50 as its core member, an A/D converter 53, an analog input circuit 52, a digital input circuit 54, a backup circuit 56, signal-changeover circuit 58, a power circuit 60, and output signal buffers 62 and 63. The analog input circuit 52 of the electronic control unit 2 receives an output signal from the airflow meter 7 indicative of intake air quantity Us, an output signal from the coolant temperature sensor 33 indicative of the coolant temperature Thw, and an output signal from the intake air temperature sensor 9 indicative of the intake air temperature Ta. These signals are then fed to the A/D converter 53 to be converted into digital signals. A voltage +B from the battery 3 is also fed via the ignition switch 29 to the A/D converter 53 to be converted into a digital signal. Digital signals obtained by the A/D converter 53 are fed to the microcomputer 50 in accordance with appropriate instructions from the microcomputer 50 as will be described in detail hereinlater.

The digital input circuit 54 receives the above-mentioned cylinder-determination signal G1 and the engine speed signal Ne from the distributer 25, a lean-rich signal Ox from the oxygen sensor 21, an output signal Idle from the idle switch 12 indicative of fully open state of the throttle valve 11, and an output signal STA from the starter switch 31 indicative of the state thereof. These digital signals are then fed to the microcomputer 50 while the cylinder-determination signal G1 and the engine speed signal Ne are also fed to the backup circuit 56.

The power circuit 60 is coupled with the vehicle-mounted battery 3 in two ways, one being direct connection for receiving backup voltage Batt and the other being a connection via the ignition switch 29 for receiving the battery voltage +B. Upon receiving Batt and +B, the power circuit 60 generates a constant voltage Vsub to be fed to the microcomputer 50 and another constant voltage Vc to be fed to remaining circuits. Furthermore, the power circuit 60 produces a signal Wi by monitoring the constant voltage Vsub, and also produces an initial signal $\overline{init}$ on the basis of a watch-dog clear signal wdc from the microcomputer 50 indicative of the normal operation thereof.

Figure 4:
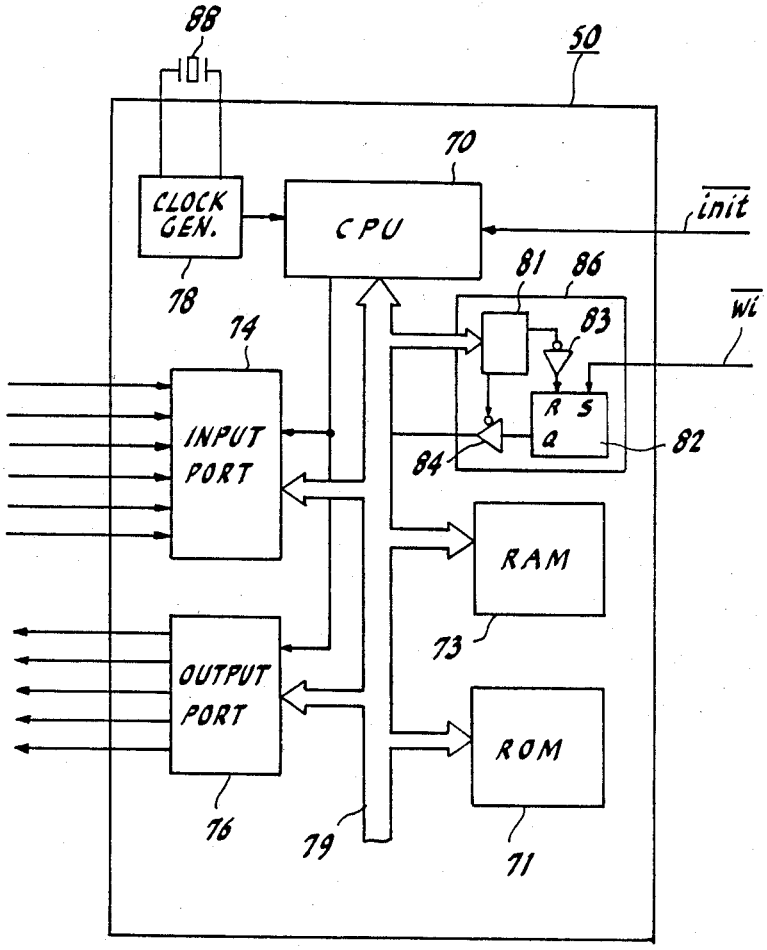
FIG. 4 is a block diagram of a microcomputer included in the electronic control unit of FIG. 3.

The microcomputer 50 used in the electronic control unit 2 of FIG. 3 may be a one-chip IC including well known CPU or microprocessor 70, a ROM 71, a RAM 73, an input port 74, an output port 76, a clock generator 78, a common bus 76 and so on as shown in FIG. 4. In the illustrated embodiment, a wi signal detecting circuit 86 is also built in where the wi signal detecting circuit 86 comprises a decoder 81, RS flip-flop 82, an inverter 83, and a bus driver 84 with a gate. The clock generator 78 is arranged to generate a basic clock signal with an external crystal 88 being connected.

The CPU 70 reads various engine operating conditions via the input port 74 so as to compute ignition timing, the amount of fuel to be injected and fuel injection timing respectively. More specifically, the CPU 70 outputs via the output port 76 various signals including a control signal of the A/D converter 53, an ignition timing control signal to be fed to the backup circuit 56, fuel injection control signals $\tau 1$ and $\tau 2$ fed to the signal changeover circuit 58, and the above-mentioned watch-dog clear signal wdc fed to the power circuit 60. In the above, the fuel injection control signal $\tau 1$ is a control signal for normal or main fuel injection performed in synchronizm with engine rotation while the other fuel injection control signal $\tau 2$ is a control signal for asynchronous fuel injection on engine start taking place according to the present inventionl. This asynchronous fuel injection control signal $\tau 2$ will be described in detail with reference to a flowchart hereinlater.

Turning back to FIG. 3, the backup circuit 56 is provided as a fail-safe circuit so that the operation of the microcomputer 50 is supplemented when the microcomputer 50 is put in an abnormal state. During the operation of the engine 1, the microcomputer 50 outputs, under the control of the CPU 70, the ignition timing control signal ig at an interval which is determined by the rotational speed Ne of the engine 1, no matter whether it is in an engine starting period or not. Therefore, when the ignition timing control signal ig is not outputted at a given interval, it is determined that the microcomputer 50 is in an abnormal state, and then an ignition signal IGt determined by the cylinder-determination signal G1 and the rotational speed signal Ne is outputted via the buffer 62 to the igniter 23. Simultaneously, a given fuel injection control signal $\tau 3$ is fed to the signal-changeover circuit 58 together with a signal $\overline{fail}$ indicating that the microcomputer 50 is in abnormal state.

Figure 5:
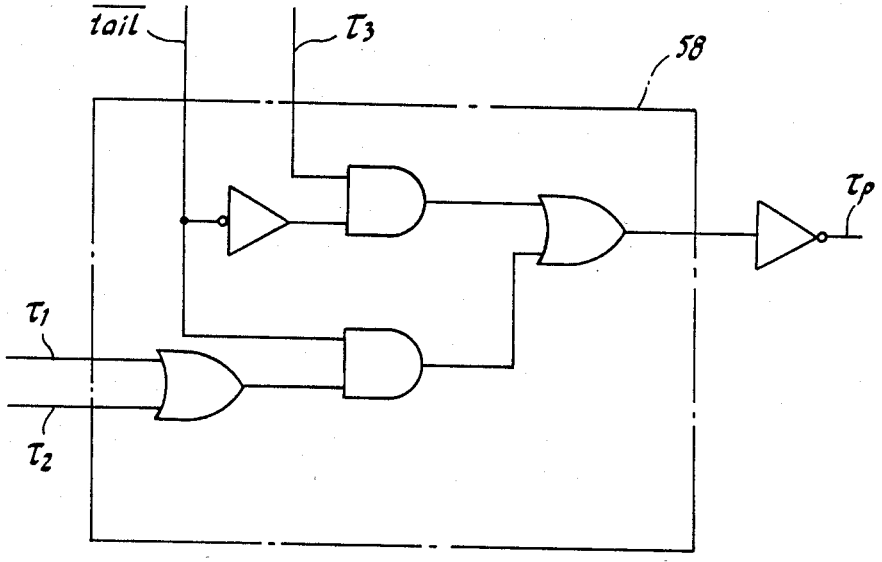
FIG. 5 is a block diagram of the signal-changeover circuit included in the electronic control unit shown in FIG. 3.

The signal-changeover circuit 58 normally outputs, via the buffer 63, a fuel injection signal $\tau p$ which causes the electromagnetic fuel injection valves 17 to open and close in receipt of the fuel injection control signals $\tau 1$ and $\tau 2$ fed from the microcomputer 50. When the backup circuit 56 outputs the signal $\overline{fail}$ by detecting the abnormal state of the microcomputer 50, the signal-changeover circuit 58 outputs the fuel injection control signal $\tau 3$ from the backup circuit 56 instead of the fuel injection control signals $\tau 1$ and $\tau 2$ so as to control the electromagnetic fuel injection valves 17 by the fuel injection control signal $\tau 3$. FIG. 5 shows an example of the signal-changeover circuit 58 formed of known logic gates.

Figure 6:
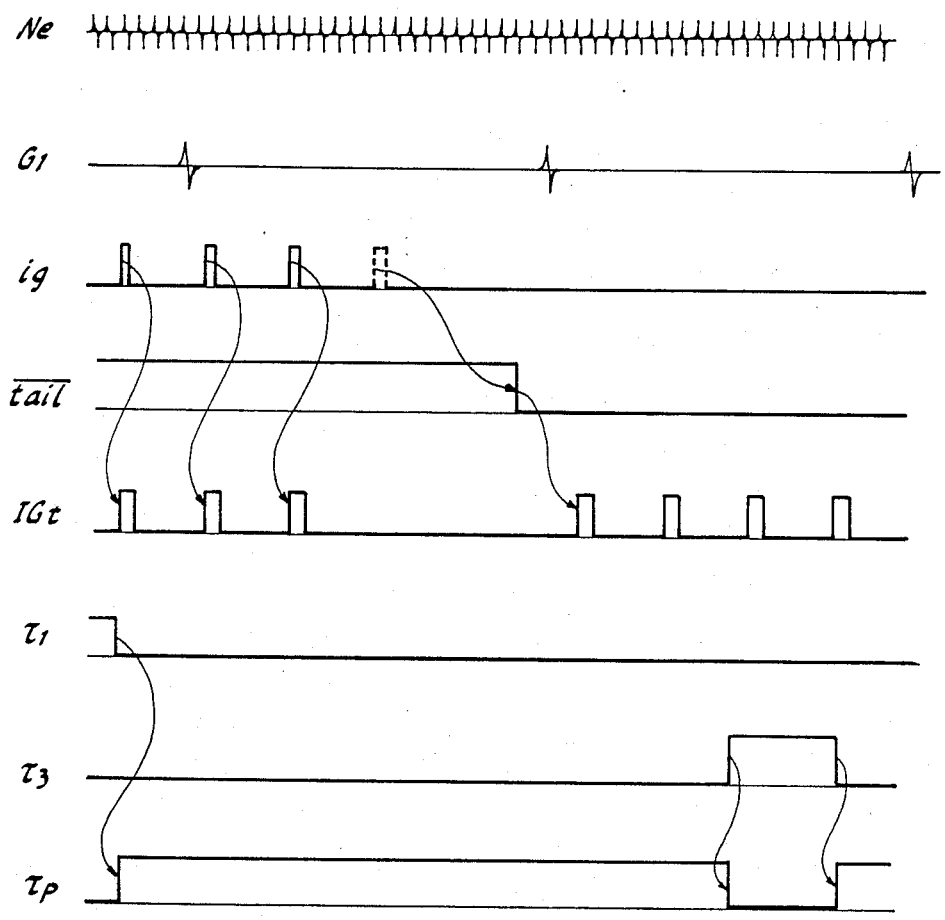
FIG. 6 is a time chart useful for understanding the operation of the electronc control unit.

FIG. 6 is a timing chart showing an example of engine control according to the above-mentioned embodiment.

Figure 7:
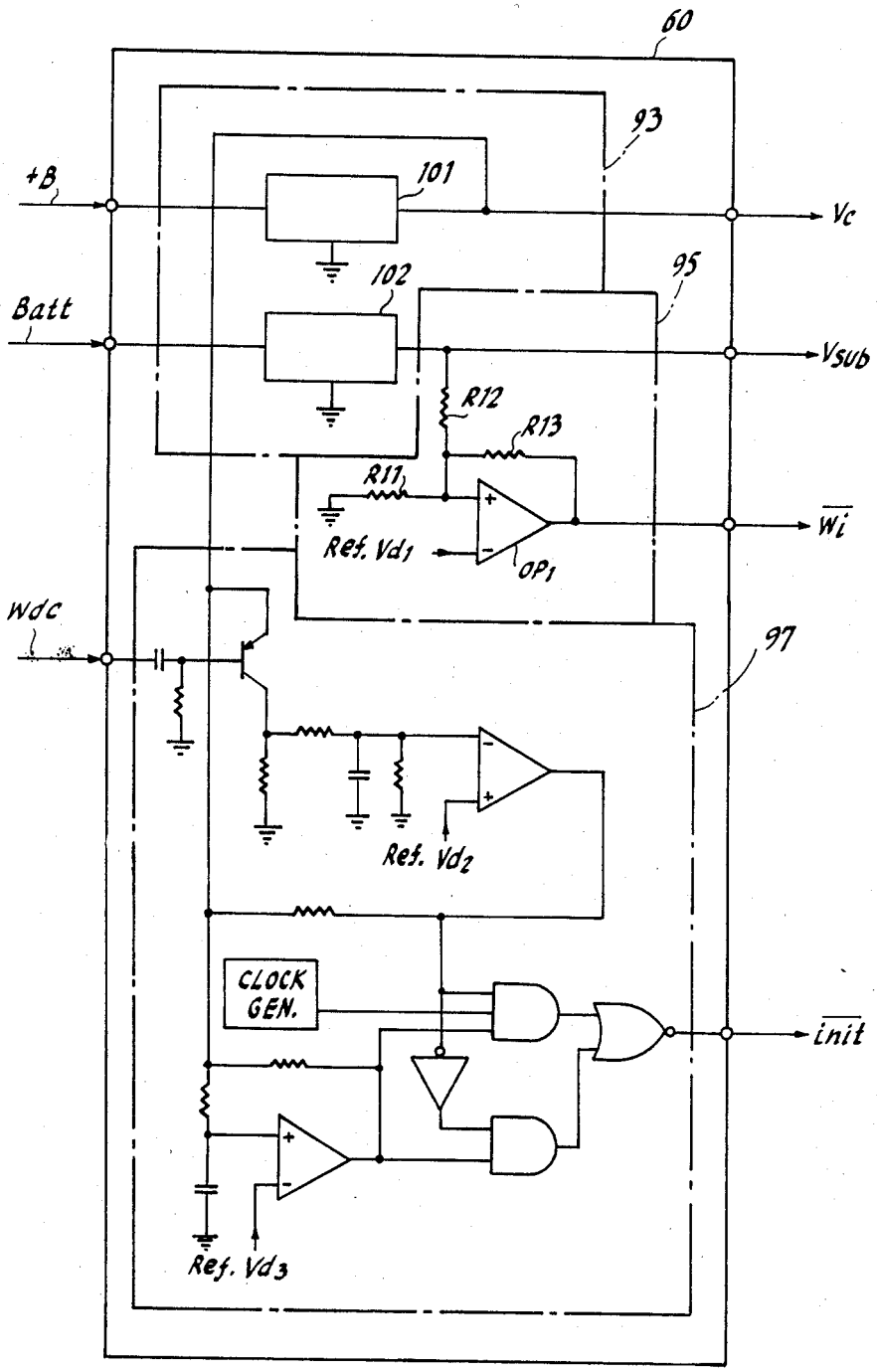
FIG. 7 is a diagram showing a power circuit included in the electronic control unit of FIG. 3.

Reference is now made to FIG. 7 showing the structure of the power circuit 60. The structure and operation of the power circuit 60 as well as the operation of the wi signal detecting circuit 86 within the microcomputer 50 will be described. As illustrated in FIG. 7, the power circuit 60 comprises a constant voltage producing portion 93, which produces the first constant voltage Vsub fed to the microcomputer 50 and the second constant voltage Vc fed to circuits other than the microcomputer 50, a wi signal outputting portion 95 for watching the first constant voltage Vsub, an initial signal generating circuit 97 for producing an initial signal $\overline{init}$ using the watch-dog clear signal wdc from the microcomputer 50.

The constant voltage outputting portion 93 comprises a regulator 101 for generating the second constant voltage Vc using the battery voltage +B as a power source, and another regulator 102 for generating the first constant voltage Vsub using the battery voltage Batt which is not fed through the ignition switch 29.

The wi signal outputting portion 95 comprises an operational amplifier OP1 which monitors the first constant voltage Vsub using a reference voltage Vd1 developed internally. When the first constant voltage Vsub drops below a determining voltage V2, then the output signal wi from the operational amplifier OP1 is made low, and when the constant voltage Vsub rises above another determining voltage V1, which is higher than V2, then the output signal wi is turned high. The determining voltage V2 is set as a voltage above which it can be determined that the operation of the CPU 70 within the microcomputer 50 is normal. Similarly, the other determining voltage V1 is set as a voltage above which the CPU 70 can determine that the control of fuel injection and so on can be restarted. In this way, these two determining voltages V1 and V2 have a difference $\Delta V$ therebetween to exhibit a hystresis characteristic with which undesirable chattering is effectively prevented when the microcomputer 50 is turned on and off. The change in the constant voltage Vsub is caused from excessive drop in the battery voltage Batt beyond the capacity of the regulator 102. The determining voltages V1 and V2 are set to be slightly higher than a voltage at which an initial signal $\overline{init}$ is produced.

The initial signal generating circuit 97 is used to disable the microcomputer 50 by producing the initial signal when the CPU is put in runaway state due to a drop in power supply voltage or noise or when the constant voltage Vsub has dropped below a voltage where normal opertion of the CPU 70 cannot be ensured. This initial signal $\overline{init}$ is also used as an initial signal produced when the electronic control unit 2 is turned on.

The above-mentioned wi siganl from the wi signal outputting portion 95 is fed to an S terminal of the RS flip-flop 82 of the wi signal detecting circuit 86 within the microcomputer 50 as shown in FIG. 4. Since the output from the inverter 83 is normally of high level, when the signal wi once turns low, the RS flip-flop 82 is set so that its output Q assumes a low level corresponding to signal 0. The CPU 70 outputs a code set in the wi signal detecting circuit 86 to open the bus driver 84 having a gate via the decoder 81 so as to read the state of the output Q of the RS flip-flop 82. Apart from this, the CPU 70 is also capable of writing data into the R terminal of the RS flip-flop 82 via the decoder 81. A truth table of the RS flip-flop 82 is shown below.

| R | W | Q |
|---|---|---|
| 1 | 0 | 0 |
| 1 | 1 | Qn-1 |
| 0 | 1 | 1 |
| 0 | 0 | Qn-1 |

In the above table, Qn-1 indicates that the output Q holds a state thereof at the time just before the state of the terminals R and S have been changed. Accordingly, when the signal wi turns low once, the state of the output Q of the flip-flop 82 is maintained as it stands even though the CPU 70 writes level 1 in the wi signal detecting circuit 86. However, when the signal wi turns high with the constant voltage Vsub being above the determining voltage V1, the state of the output Q is inverted by the writing operation from the CPU 70 to assume high level. The code of the wi signal detecting circuit 86, which is read and written by the CPU 70, is referred to as the WI port.

The operation of the CPU 70 of the microcomputer 50 in the electronic control unit 2 will be described with reference to a flowchart of FIG. 8. The CPU 70 is arranged to execute an interrupt service routine shown in the flowchart of FIG. 8 at a given interval, such as 4 msec, as a fuel injection control on engine start. The contents of processing in each step will be described hereinbelow.

Step 200: It is determined whether the starter motor 32 is driven or not by detecting the state of the signal STA.

Step 210, 220: Logic "1" is written into the WI port, i.e. wi signal detecting circuit 86.

Step 230, 240: It is checked whether the value of WI portion is of logic "1" or not.

Step 260: It is determined whether a variable CTIME corresponding to a single asynchronous fuel injection is less then t2 or not.

Step 270: The variable CTIME is set to t1 which is larger than t2 by 2 or more.

Step 280: The variable CTIME to be used as a count of a counter is reset to zero.

Step 283: A variable INJDLY, which defines a delay time in processing, is reset to zero.

Step 285: It is determined whether the value of the variable INJDLY is greater than or equal to 5 or not. Since this control routine is executed at an interval of 4 msec, when the variable INJDLY is 5, it means that a delay time of $5\times4$ msec is provided.

Step 288: The variable INJDLY is incremented by 1, i.e. INJDLY←INJDLY+1.

Step 290: The variable CTIME is incremented by 1, i.e. CTIME←CTIME+1.

Step 300: Turn on the fuel injection control signal $\tau$ to be outputted.

Step 310: Turn off or maintain the fuel injection control sinal $\tau$ to be outputted.

The above-mentioned steps are executed in the following order.

(1) The operation starts at the step 200. When the ignition switch 29 is turned on to start the engine 1, the voltage +B of the battery 3 is fed to the electronic control unit 2. Since the starter switch 31 of FIG. 2 is not closed immediately after the ignition switch 29 is turned on, the starter motor 32 is not energized at the very beginning. Therefore, the determination in the step 200 results in NO to execute step 210. In step 210, logic "1" is written in WI port, and then a value t1 is written as the variable CTIME in step 270. Then in step 283, the variable INJDLY is set to zero, and then the fuel injection control signal $\tau2$ is turned off in step 310 to complete a first execution of the interrupt routine through RTN.

(2) Meanwhile, the starter switch 31 is closed to cause the starter motor 32 to receive electrical power from the battery 3 to start driving the engine 1. Therefore, when the interrupt routine is started under this condition, the determination in step 200 results in YES to execute step 230 where it is checked whether WI port =1 or not. Since logic "1" has been written in the WI port in the former cycle, the value of WI port continuously assumes logic "1" unless the constant voltage. Vsub, which is fed to the microcomputer 50 as its power supply, drops due to the application of load of the starter motor 32. On the other hand, when the constant voltage Vsub is below the determination voltage V2, the value of WI port is then logic "0". In the case that the battery 3 has sufficient capacity so that the constant voltage Vsub does not drop, the determination in step 230 results in YES to proceed to step 260 where determination of CTIME <t2 is made. Since the value of the variable CTIME has been set to t1 in step 270 of the first cycle of the execution of the interrupt routine, the determination in step 260 results in NO to execute step 310. Accordingly, the fuel injection control signal $\tau 2$ is maintained at its off state to complete the execution of this cycle through RTN.

Figure 9:
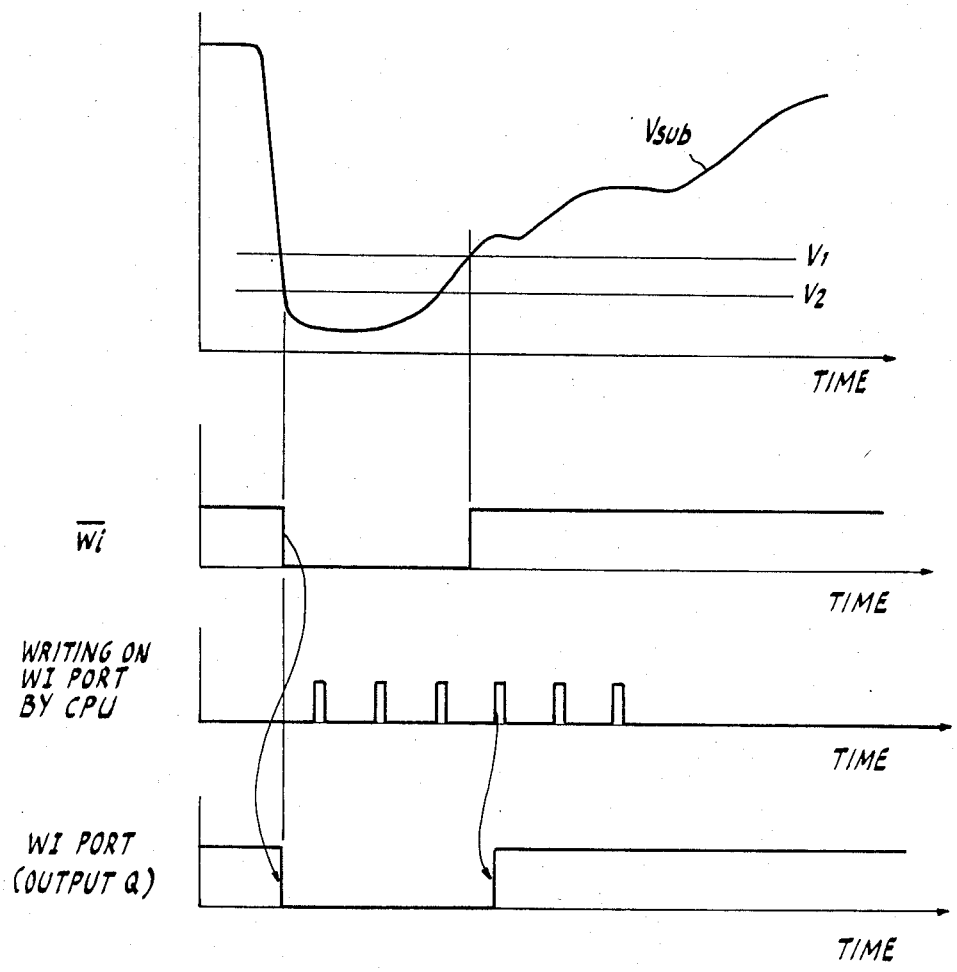
FIG. 9. is a waveform chart useful for understanding the operation of the electronic control unit.

(3) On the other hand, when the voltage +B of the battery 3 drastically drops as the load of the starter motor 32 is applied when the battery 3 is in poor condition, and when the constant voltage Vsub fed to the microcomputer 50 drops below the determination voltage V2, the determination in step 230 results in NO, i.e. WI =1 is not satisfied, to proceed to step 220. In step 220, logic "1" is written in WI port, and in a subsequent step 240 it is checked again whether WI port is of logic "1" or not. Since the value of WI port is not renewed to logic "1" even though the CPU 70 writes logic "1" as long as the signal wi is of low level, the determination in step 240 results in NO so that the operational flow goes to step 310 and then to RTN as described in the above after the constant voltage Vsub drops below the determining voltage V2 and before the constant voltage Vsub exceeds another determining voltage V1. After the constant voltage Vsub exceeds the determining voltage V1 through the fluctuation of the load of the starter motor 32, the value of WI port is set to logic 1 through the execution of steps 220 and 230, and then the determination in step 240 results in YES. This operation is shown in FIG. 9. In detail, the WI port assumes low level when the signal wi turns low, and the state of the WI port returns to high level in response to the first data writing by the CPU 70 after the signal wi turns high.

(4) When the determination in step 240 results in YES, i.e. WI port =1, operational flow proceeds to step 280. In step 280, the value of the variable CTIME is set to zero under an assumption that conditions for starting asynchronous fuel injection have been satisfied. In subsequent step 283, the variale INJDLY is set to zero, and then the operational flow goes via step 310 to RTN.

After the above-mentioned processing is performed, the determination in all the steps 200, 230 and 260 results in YES to proceed to step 285 whenever this interrupt routine is executed until the constant voltage Vsub goes below the determination voltage V2. At the beginning the value of the variable INJDLY is zero as set so in step 283, and therefore, the determination in step 285 results in NO to proceed to step 288 in which the variable INJDLY is incremented by 1. Then the operational flow goes to step 310 and then to RTN. Therefore, even if the constant voltage Vsub exceeds the determination voltage V1, asynchronous fuel injection is not immediately performed, and thus fuel injection is not started until this interrupt routine is repeated five times with the variable INJDLY being counted.

In a sixth cycle of the interrupt service routine, the determination of the step 285, i.e. INJDLY ≧5 ? , results in YES to proceed to step 290 in which the variable CTIME is incremented by 1 which variable determines the amount of fuel to be injected by the asynchronous injection on engine start. In the subsequent step 300, the fuel injection control signal $\tau 2$ is turned on so as to start asynchronous fuel injection on engine start. After the completion of step 300, the operational flow goes to RTN to terminate the execution of this interrupt routine. When the fuel injection control signal $\tau 2$ turns low, the output signal $\tau p$ from the electronic control circuit 2 becomes active to open the electromagnetic fuel injection valves 17.

(5) When the interrupt routine is executed under the above conditions, since the value of WI port is of logic "1" until the constant voltage Vsub drops below the determination voltage V2, the determination in step 230 results in YES, and then in step 260 it is checked whether the variable CTIME is less than t2 or not. The value of variable CTIME is set to 0 in step 280, and is incremented by 1 each time step 290 is executed. Therefore, the determination in step 260 results in YES until the variable CTIME reaches t2, i.e. 50 msec in this embodiment, and the value of the variable INJDLY is 5 at this time. Thus, the determination in step 285 results in YES, and steps 290 and 300 follow to perform asynchronous fuel injection on engine start through fuel injection control signal $\tau 2$.

(6) When 50 msec has lapsed under this condition, then the determination in step 260 of CTIME <t2 ? results in NO so that the operational flow goes via step 310 to RTN to terminate asynchronous fuel injection. After this, the battery voltage +B fluctuates as the starter motor 32 rotates, and when the constant voltage Vsub drops below the determination voltage V2 again and then rises above the higher determination voltage V1, the processing is repeated again from the above-mentioned (3).

(7) The above-mentioned control is continued until the battery voltage +B becomes sufficiently high as the result of self rotation of the engine 1 after ignition takes place so that the constant voltage Vsub never drops below the determination voltage V2, or until the starter motor 32 is turned off.

Figure 8:
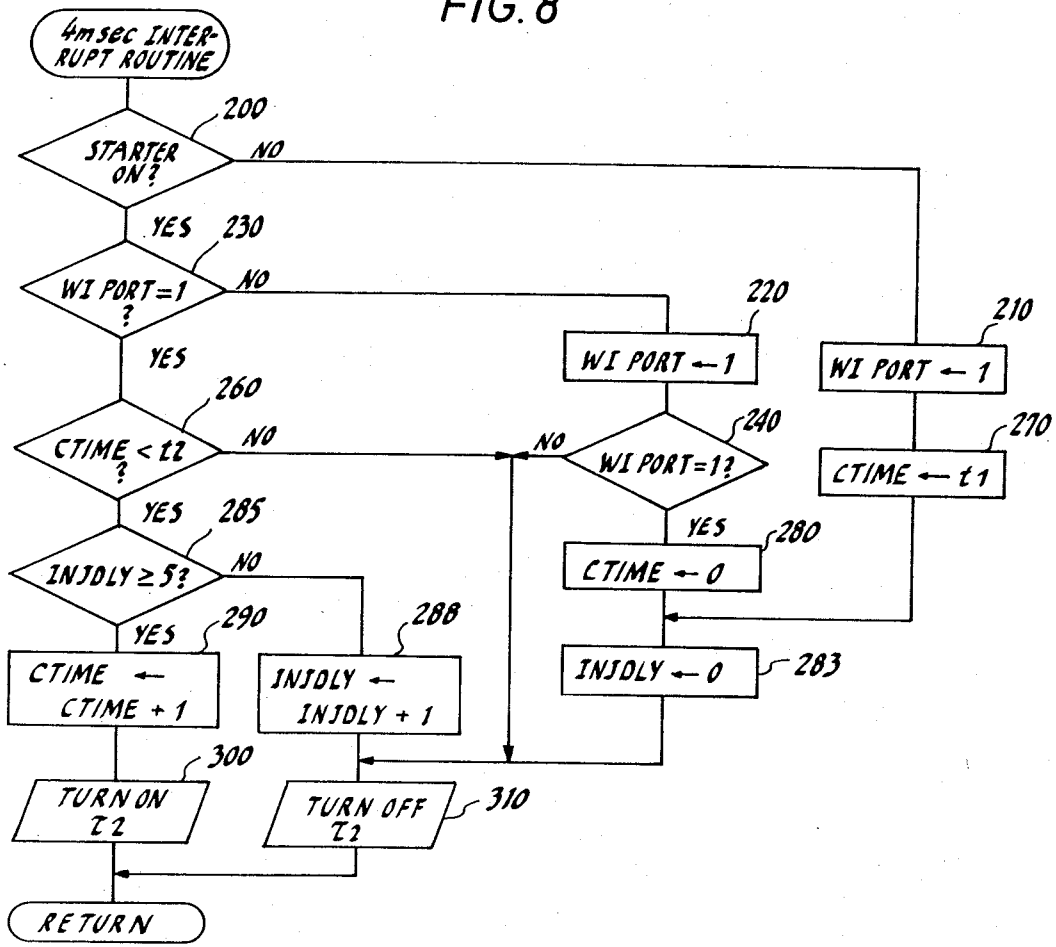
FIG. 8 is a flowchart of an interrupt routine executed by the microcomputer of FIG. 4, showing a first embodiment.
Figure 10:
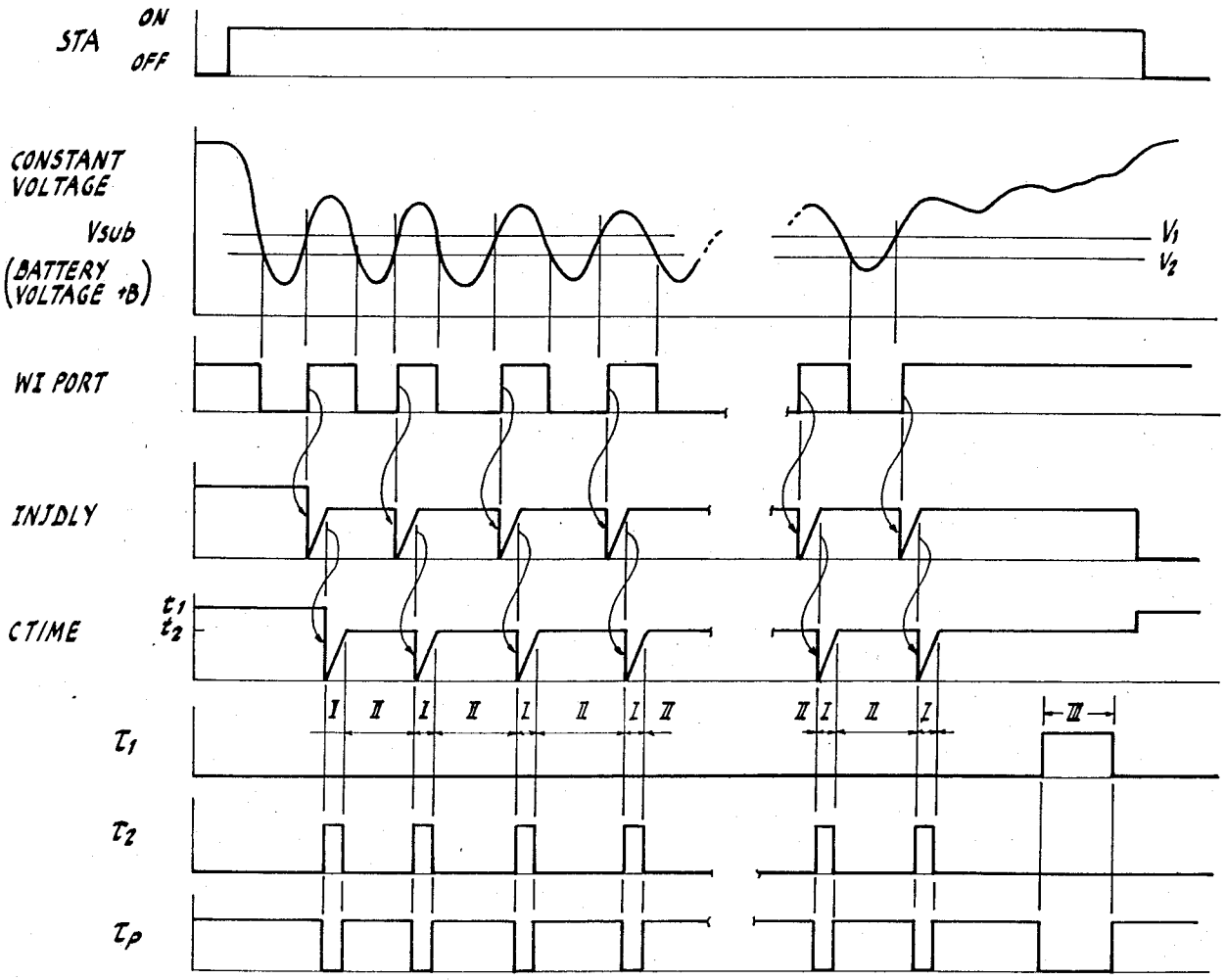
FIG. 10 is a waveform chart useful for understanding the operation of the first embodiment

FIG. 10 is a timing chart showing an example of fuel injection control performed on engine start which is performed by repeatedly executing the interrupt routine of FIG. 8. In detail, the asynchronous fuel injection on engine start is performed (see period I in FIG. 10) using the value of the variable CTIME as a count of a counter when the constant voltage Vsub goes beyond the determination voltage V1 after it drops below the determination voltage V2, and is terminated when the variable CTIME equals t2 (see period II). Normal fuel injection is performed apart from this asynchronous fuel injection such that normal fuel injection is performed after the constant voltage Vsub is established (see period III).

In the above-described first embodiment, the state of the constant voltage Vsub, which is power supply voltage fed to the CPU 70, is watched by the wi signal outputting portion 95, and when Vsub rises above a voltage, i.e. the determination voltae V1, where no problem occurs in connection with the resumption of the operation of the CPU 70, asynchronous fuel injection of pulse width of 50 msec, which is inherent in engine start, is performed. Therefore, even if the constant voltage Vsub varies so that it assumes a low voltage with which the normal operation of the CPU 70 cannot be ensured, when the constant voltage Vsub exceeds the determination voltage V1, the asynchronous fuel injection on engine start is immediately started. As a result, fuel injection is accurately performed on engine start so that air-fuel mixture is securely sucked into engine cylinders to enhance starting characteristic of the engine 1.

Even if the constant voltage Vsub drops below the determination voltage V2 so that the $\overline{\text{init}}$ signal is produced by the power circuit 60 to reset the microcomputer 50, when the constant voltage is restored to be higher than the determination voltage V1, asynchronous fuel injection on engine start is executed using the fuel injection control singal $\tau$2 without waiting for the normal or main fuel injection which is carried out with fuel injection duration being computed using the rotational speed Ne of the engine 1 and other parameters. Therefore, fuel is securely sucked into engine cylinders.

The present invention can be achieved by adding some electrical circuits to conventional control apparatus, and since fuel injection control is peformed using a single CPU, the fuel injection system does not require a start injecter or other additional fuel supply system so that fuel injection on engine start can be obtained with simple construction.

In the first embodiment, when the constant voltage Vsub is continuously below the determination voltage V2 so that the CPU 70 cannot produce ignition control signal ig, ignition timing and fuel injection are controlled by the backup circuit 56. Therefore, the starting characteristic of the engine 1 is substantially perfect with voltage range where the starter motor 32 is driven.

Figure 11:
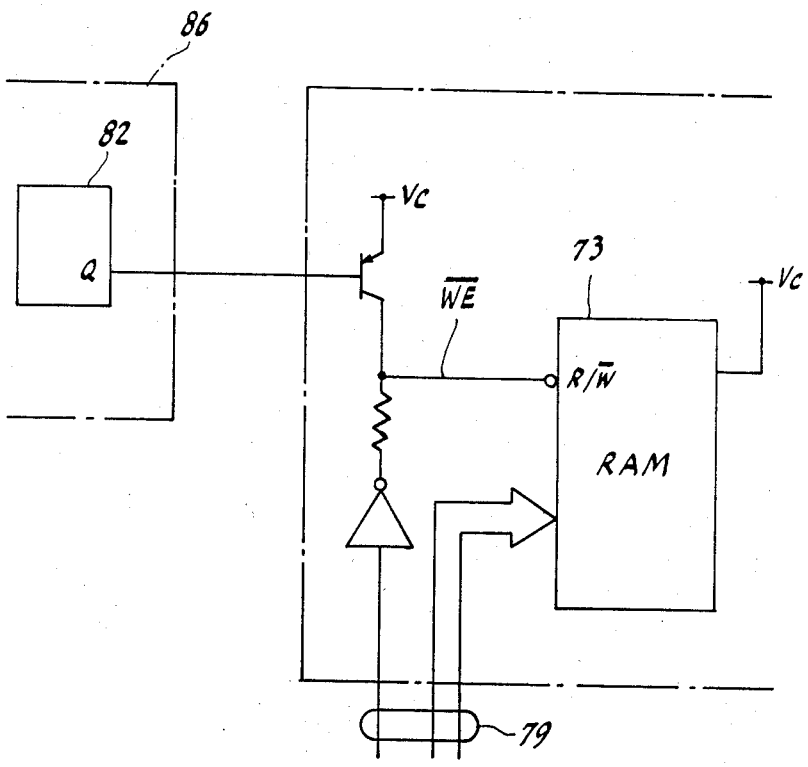
FIG. 11 is a diagram showing one feature of a second embodiment of the present invention.

A second embodiment of the present invention will be described with reference to FIGS. 11 through 15. The second embodiment is a modification of the above-described first embodiment, and therefore only different portions are described. FIG. 11 shows the relationship between the wi signal detecting circuit 86 and the RAM 73 included in the microcomputer 50 used in the second embodiment. While the wi signal detecting circuit 86 and the RAM 73 are arranged as shown in FIG. 4 in the first embodiment, the output Q of the RS flip-flop 82 of the wi signal detecting circuit 86 is used to disable writing operation into the RAM 73 as follows in the second embodiment. When the siganl Q assumes low level, a control signal line WE connected to read/write (R/W) control terminal is rendered high so as to disable writing operation into the RAM 73. More specifically, the voltage at the read/write control terminal R/W of the RAM 73 is made substantially equal to positive power supply voltage Vc through a transistor responsive to the signal Q.

Figure 12:
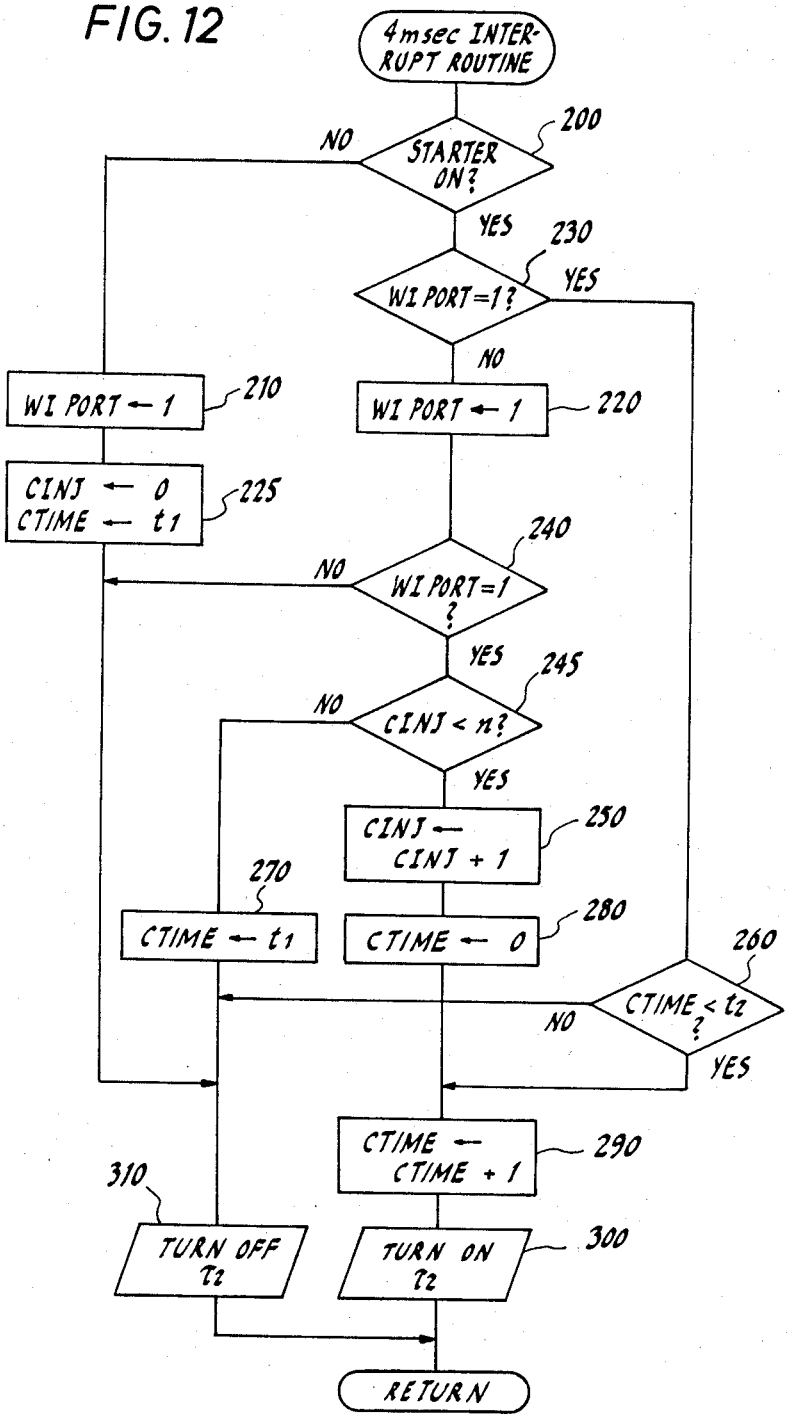
FIG. 12 is a flowchart of an interrupt routine executed by the microcomputer of FIG. 4, showing the second embodiment.

The operation of the second embodiment will be described with reference to a flowchart of FIG. 12. The flowchart of FIG. 12 is similar to FIG. 8, and therefore, only different steps will be described. The operation shown by the flowchart of FIG. 12 is repeatedly executed as an interrupt service routine at an interval of 4 msec in the same manner as in the first embodiment, and steps which are newly provided in the second embodiment are as follows:

Step 225: A variable CINJ indicative of the number of times of fuel injection on engine start is set to 0, and a variable indicative of the amount of fuel to be injected by a single injection is set to t1.

Step 245: It is checked whether the value of the variable CINJ is smaller than n or not.

Step 250: The variable CINJ is incremented by 1, i.e. CINJ←CINJ+1.

Remaining steps in FIG. 12 are the same as those shown in FIG. 8 and therefore, description thereof is omitted.

The above-mentioned newly provided steps 245 and 250 are inserted between steps 240 and 280 of the flowchart of FIG. 8, while another new step 225 is added to follow the step 210. The step 270 which follows the step 210 in FIG. 8 is now arranged to follow the new step 245. Steps 283, 285 and 288 of FIG. 8 are not used in the second embodiment.

The operation of the second embodiment will be described in connection with those which are different from the first embodiment. In detail, the operation described in connection with the first embodiment with reference to FIG. 8 under (1) to (3) are also executed in the second embodiment in the same manner, with an exception that step 225 is provided for setting the variable CINJ to 0 and another variable CTIME to t1. Now the operation following (3) will be described.

(4) When the determination in step 240 is YES, i.e. WI port =1, the operational flow goes to step 245 in which it is determined whether the variable CINJ is smaller than n or not. This variable CINJ is used as a count of a counter indicative of the number of asynchronous fuel injections performed on engine start after the starter motor 32 is turned. Therefore, the value of the variable CINJ is zero, i.e. the value is the same as it has been set in step 225, in the first determination in step 245. As a result, the determination of CINJ <n ? in step 245 results in YES to proceed to step 250. In step 250, the variable CINJ is incremented by 1 to count the number of asynchronous fuel injections. With the provision of the steps 245 and 250, therefore, asynchronous fuel injection is performed n times. The variable CINJ is stored in a given area of the RAM 73. In a following step 280, another variable CTIME is set to zero so as to set the duration for the asynchronous fuel injection to a predetermined value, such as 50 msec in the same manner as in the first embodiment. In a following step 290, the value of the variable CTIME is incremented by 1, and the renewed value is stored in a given area of the RAM 73. Then in step 300, the fuel injection control signal $\tau$2 is turned on to proceed to RTN to terminate the execution of the interrup routine. When the fuel injection control signal $\tau$2 is turned on, the output signal $\tau$p of the electronic control circuit 2 is made active so that the electromagnetic fuel injection valves 17 are opened.

(5) When the interrupt routine is executed under the above conditions, since the value of WI port is of logic "1" until the constant voltage Vsub drops below the determination voltage V2, the determination in step 230 results in YES, and then in step 260 it is checked whether the variable CTIME is less than t2 or not. The value of variable CTIME is set to 0 in step 280; and is incremented by 1 each time step 290 is executed. Therefore, the determination in step 260 results in YES until the variable CTIME reaches t2, i.e. 50 msec in this embodiment, and the value of the variable INJDLY is 5 at this time. Thus, the determination in step 285 results in YES, and steps 290 and 300 follow to perform asynchronous fuel injection on engine start through fuel injection control signal $\tau$2.

(6) When 50 msec has lapsed under this condition, then the determination in step 260 of CTIME <t2 ? results in a NO determination so that the operational flow goes via step 310 to RTN to terminate asynchronous fuel injection. After this, the battery voltage +B fluctuates as the starter motor 32 rotates, and when the constant voltage Vsub drops below the determination voltage V2 again and then rises above the higher determination voltage V1, the processing is repeated again from the above-mentioned (3). Each time the above-mentioned control of (4) is executed, the value of the variable CINJ is incremented by 1.

(7) When the variable CINJ reaches n as the result of successive increment, the determination in step 245 becomes YES. Then the variable CTIME is set to t1 in step 270, and then the fuel injection control signal $\tau 2$ is turned off in step 310 to terminate the execution of the interrupt routine. Therefore, when the total amount of fuel injected through asynchronous fuel injection on engine start reaches a value given by n×50 msec, which is determined by a product of fuel injection duration (50 msec in this embodiment) corresponding to t2 and n indicative of the number of asynchronous fuel injections, further asynchronous fuel injection is not performed irrespective of the state of the constant voltage Vsub.

In the above-described control, writing into the RAM 73 of the microcomputer 50 is prevented or prohibited when the constant voltage Vsub drops below the determination voltage V2, and therefore, the values of the variables CINJ and CTIME are unchanged even if the battery votlage +B fluctuates due to the variation in the load of the starter motor 32.

Figure 13:
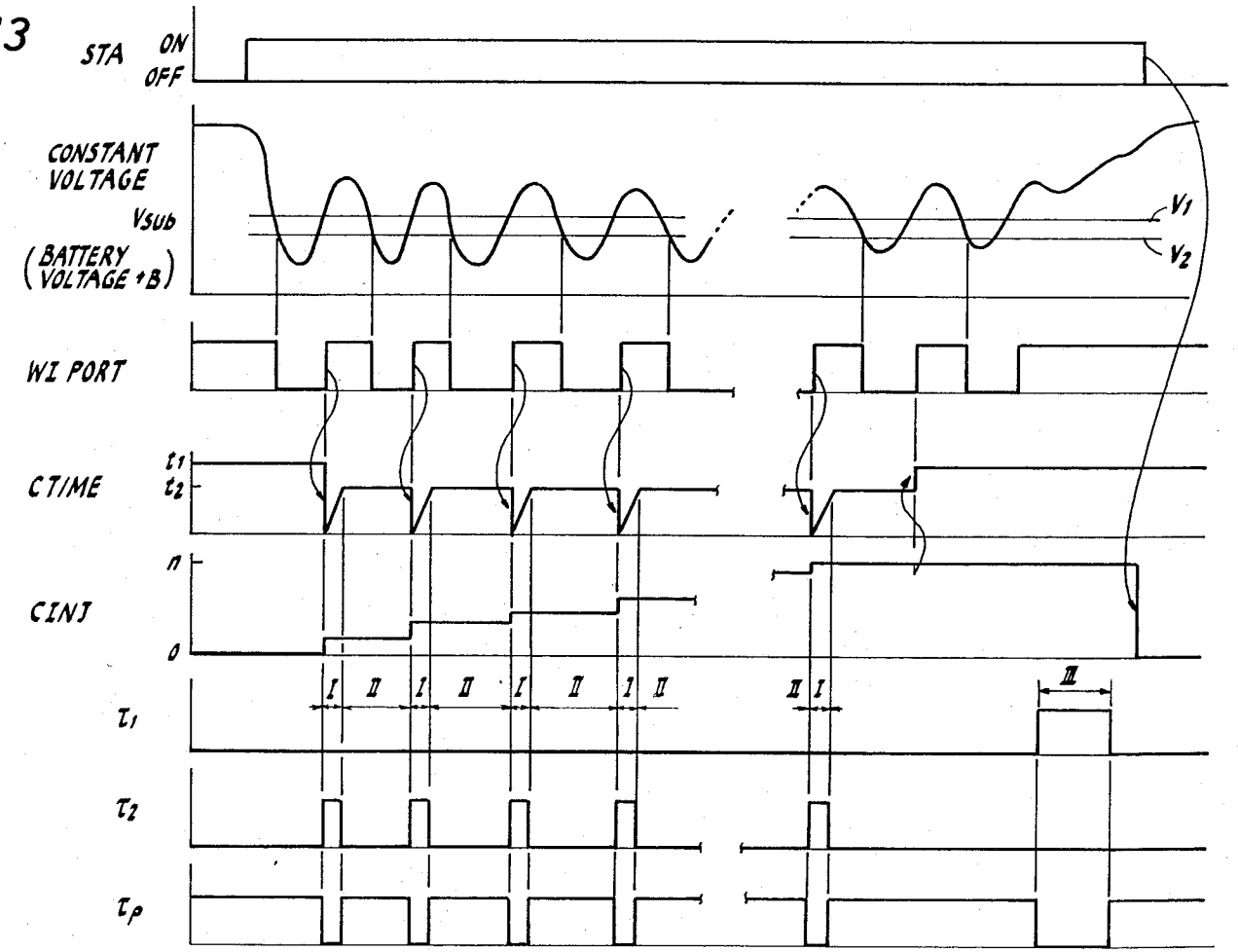
FIG. 13 is a waveform chart useful for understanding the operation of the second embodiment.

FIG. 13 is a timing chart showing an example of fuel injection control performed on engine start which is performed by repeatedly executing the interrupt routine of FIG. 12. In detail, the asynchronous fuel injection on engine start is performed (see period I in FIG. 13) using the value of the variable CTIME as a count of a counter when the constant voltage Vsub goes beyond the determination voltage V1 after it drops below the determination voltage V2, and is terminated when the variable CTIME equals t2 (see period II). The asynchronous fuel injection carried out each time the constant voltage Vsub fluctuates up and down beyond the determination voltages V1 and V2 is performed n times in total on engine start. Normal fuel injection is performed apart from this asynchronous fuel injection such that normal fuel injection is performed after the constant voltage Vsub is established (see period III).

In the above-described second embodiment, the state of the constant voltage Vsub, which is power supply voltage fed to the CPU 70, is watched by the wi signal outputting portion 95 and when Vsub rises above a voltage, i.e. the determination voltage V2, where the operation of the CPU 70 can be ensured, the contents of the RAM 73 are kept and preserved, and when Vsub rises above a voltage, i.e. the determiantion voltage V1, where no problem occurs in connection with the resumption of the operation of the CPU 70, asynchronous fuel injection of pulse width of 50 msec, which is inherent in engine start, is performed. Therefore, even if the constant voltage Vsub varies so that it assumes a low voltage with which the normal operation of the CPU 70 cannot be ensured, when the constant voltage Vsub exceeds the determination voltage V1, the asynchrnous fuel injection on engine start is immediately started. As a result, fuel injection is accurately performed on engine start so that air-fuel mixture is securely sucked into engine cylinders to enhance starting characteristic of the engine 1. Furthermore, since the variable CINJ stored in the RAM 73 is kept unchanged, the total amount of fuel to be injected on engine start can be maintained constant. Therefore, execessive fuel supply is effectively prevented so that spark plugs are prevented from getting wet. As a result, undesirable misfiring caused from wet spart plugs is avoided. Therefore, starting characteristic of the engine 1 is disirably ensured.

Figure 15:
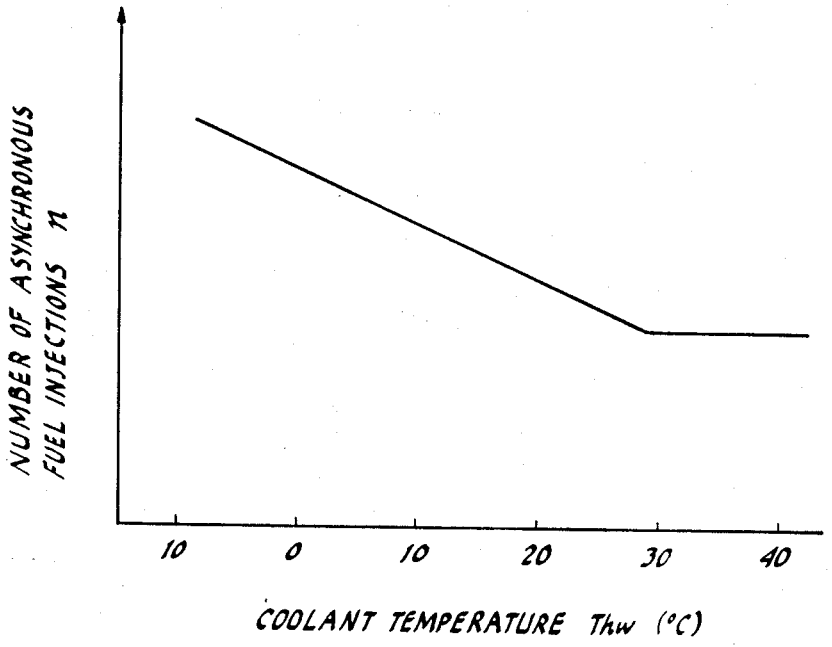
FIG. 15 is a graph showing a map used in the flowchart of FIG. 14.
Figure 14:
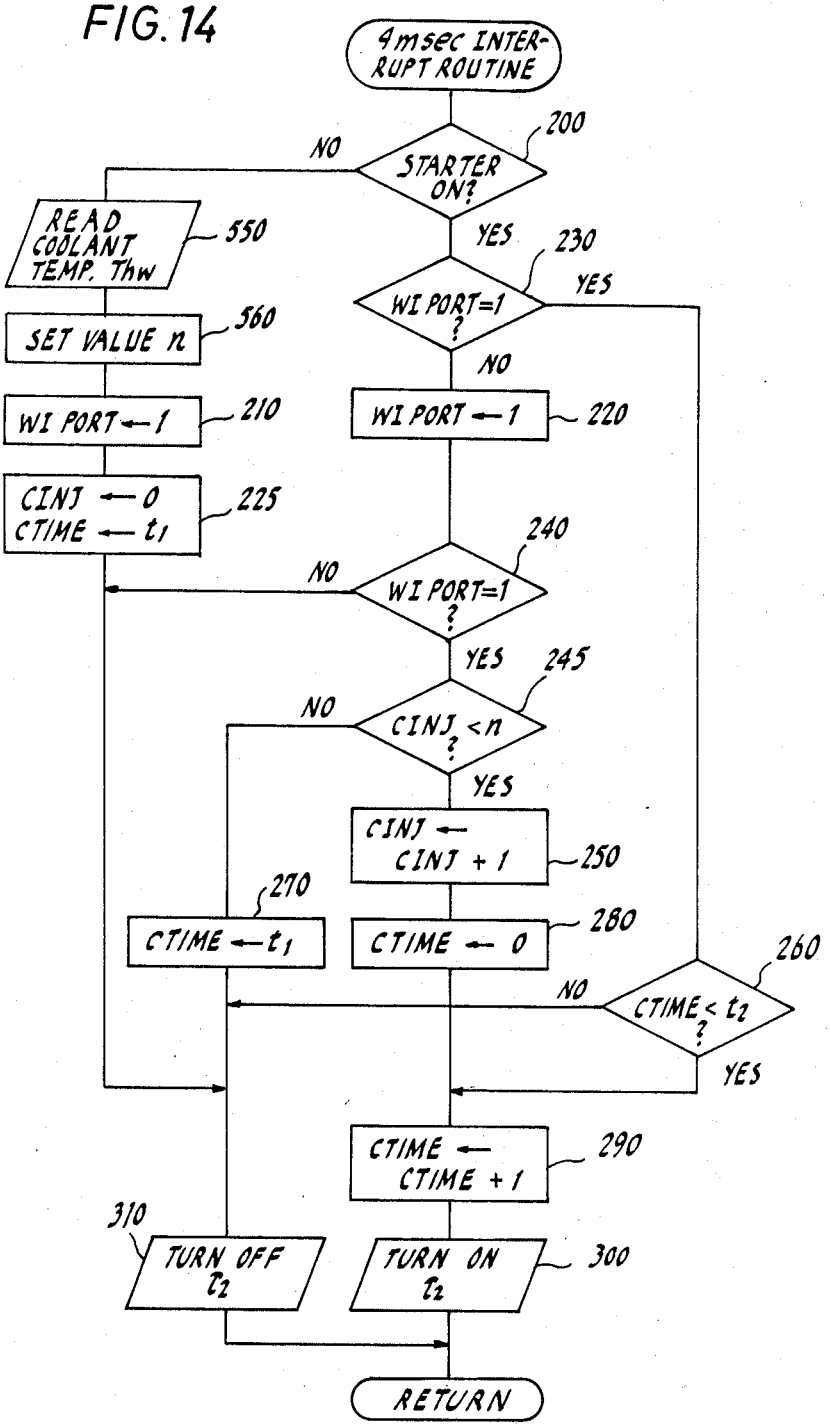
FIG. 14 is a flowchart of an interrupt routine showing a modification of the second embodiment.

FIG. 14 shows a modification of the above-described second embodiment. This modification differs from the second embodiment in that new steps 550 and 560 are additionally provided to the flowchart of FIG. 12. The step 550 is provided for reading, via the input port 52, engine coolant temperature Thw indicated by an output signal from the coolant temperature sensor 33 (see FIG. 2). Another step 560 is provided for setting the above-mentioned value n used in step 445. These new steps 550 and 560 may be provided prior to steps 210 and 225 as shown to be executed after the ignition switch 29 is turned on and before the starter motor 32 is turned on. This value n indicative of the number of times of asynchronous fuel injections to be performed on engine start is determined in accordance with the detected coolant temperature Thw. For instance, the value of n may be determined using a map, one example of which is shown in FIG. 15.

With the provision of the steps 550 and 560, the total amount of fuel (corresponding to n×50 msec) to be injected into engine cylinders on engine start through the asynchronous fuel injection performed after the starter motor 32 is turned on, can be changed depending on the engine coolant temperature Thw.

As a result, the modification of the second embodiment is advantageous when the engine 1 is started under low temperature condition. In detail, the total amount of fuel is increased when the coolant temperature Thw is low because most portion of injected fuel is apt to attach to inner wall of the intake pipe or to intake valve when the engine 1 is started under completely cooled state. On the other hand, when the coolant temperature Thw is not low, the total amount of fuel is suppressed to prevent the spark plugs from getting wet. In this way, the starting characteristic of the engine 1 is properly ensured.

The circuit arrangement shown in FIG. 11 for prohibiting writing into the RAM 73 is one example, and therefore, it may be replaced with another structure. For instance, the initial signal to the microcomputer 50 may be produced with the output signal wi from the wi signal detecting circuit 86 and the initial signal $\overline{init}$ from the initial signal generating circuit 97 being ANDed.

A third embodiment of the present invention will be described with reference to FIGS. 16 through 18. The third embodiment differs from the above-described embodiments in that the normal fuel injection is prohibited during engine start. In the third embodiment, when $\overline{init}$ signal outputted from the power circuit 60 immediately after power is applied, disappears, then the CPU 70 performs initialization, and then executes a normal fuel injection control routine as one of various controls of the engine 1. In the above-mentioned intialization, the contents of internal registers of the CPU 70 are cleared, and various flags including normal fuel injection prohibiting flag, which will be described hereinlater, are reset to initial value, such as 1.

Figure 16:
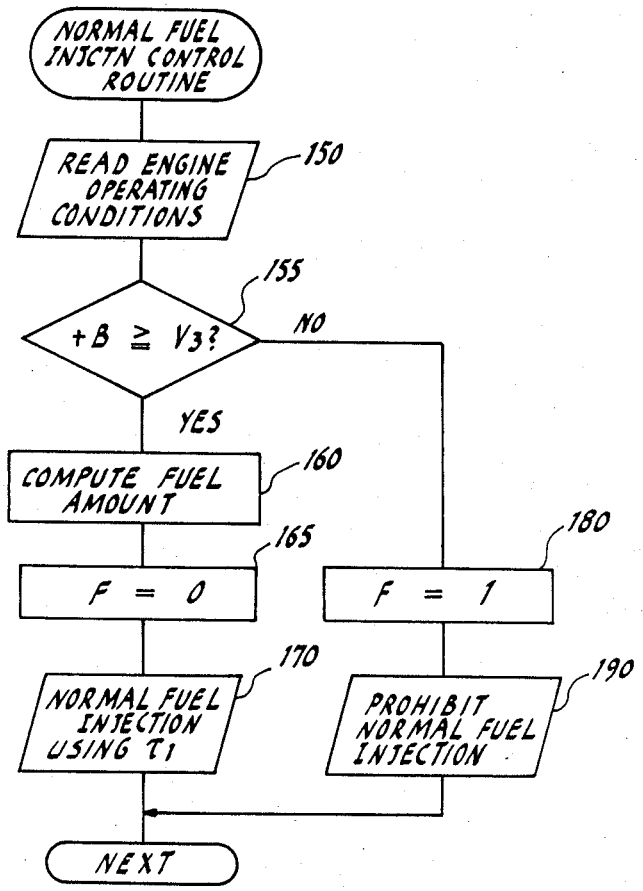
FIG. 16 is a flowchart of a normal or main fuel injection control routine used in a third embodiment of the present invention.

FIG. 16 shows this normal fuel injection control routine. In a first step 150, various operating conditions of the engine 1 are read. As the operating conditions, engine rotational speed Ne, intake air quantity US, the coolant temperature Thw, the battery voltage +B and so on are used. Then in a following step 155, it is checked whether the battery voltage +B is equal to or higher than a predetermined voltage V3 such as 7 V or not. This voltage V3 is determined as a third watching voltage above which the operation of the CPU 70 is ensured.

If $+B \geqq V3$ is satisfied in the determination of step 155, the operational flow proceeds to step 160 to compute the amount of fuel to be injected through normal fuel injection using the engine operating conditions. This fuel amount is represented by time length $\tau 1$ corresponding to duration of fuel injection. The fuel amount to be injected through normal fuel injection is determined in accordance with engine load, such as Q/Ne wherein Q is intake air quantity. Then determined fuel amount is corrected through well known warm up fuel increase correction performed using the coolant temperature Thw, and acceleration fuel increase correction so as to obtain final fuel amount. In a subsequent step 165, a flag F indicative of the prohibition of normal fuel injection is reset to 0 since the condition for performing normal fuel injection ($+B \geqq V3$) has been satisfied. Then in a subsequent step 170, normal fuel injection is carried out using the fuel amount (injection duration) $\tau 1$ obtained in step 160.

On the other hand, when the determination in step 155 results in NO, namely, when the battery voltage is below approximately 7 V, the operational flow proceeds to step 180 in which the flag F is set to 1. Then in step 190, normal fuel injection is interrupted, if it has already started, and further normal fuel injection is prohibited. After steps 180 and 190 are completed, the flow goes to NEXR to terminate the present control routine.

Figure 17:
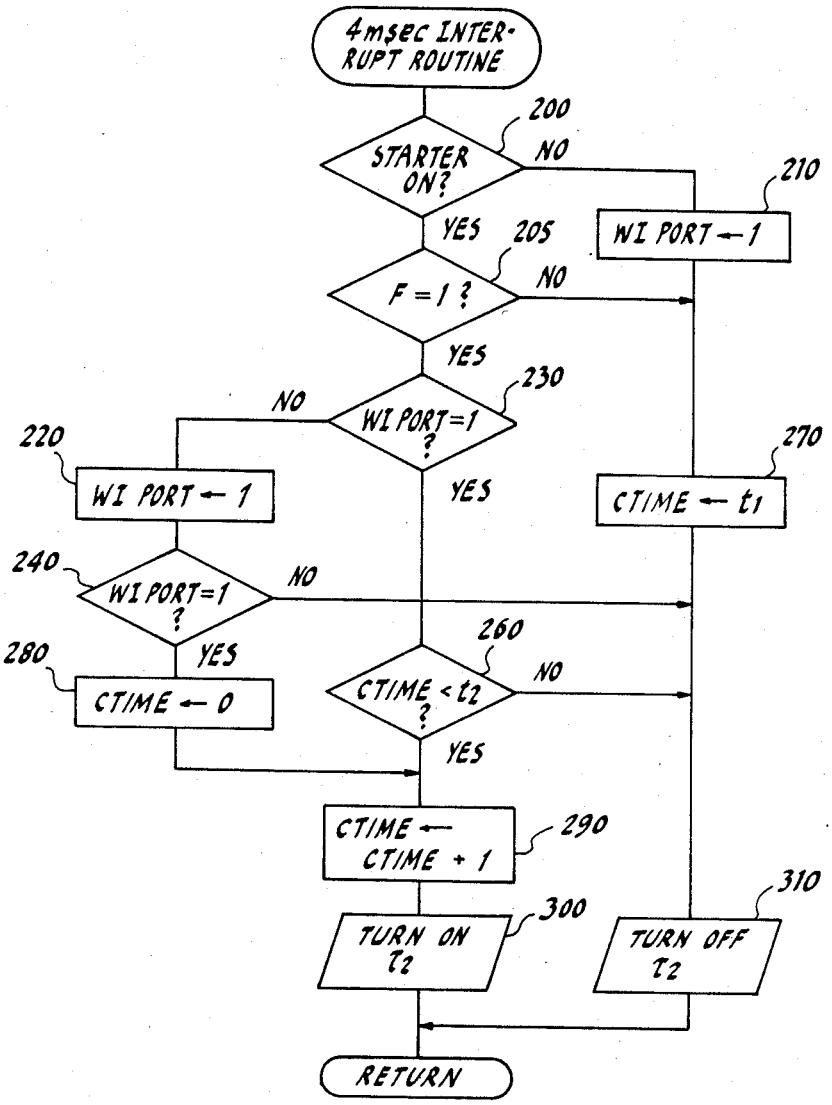
FIG. 17 is a flowchart of an interrupt routine showing the third embodiment.

Reference is now made to FIG. 17 showing an interrupt service routine used in the third embodiment. This interrupt routine is periodically executed at an interval of 4 msec in the same manner as in previous embodiments. In FIG. 17, steps other than step 205 are the same as those in the flowchart of FIG. 8. The step 205 is provided for checking whether the flag F is 1 or not. If the flag F is 1, the operational flow proceeds to a step 230. On the other hand, if the flag F is not 1, the operational flow goes to step 270. The initial value of the flag F is 1, and this flag F is set to either 1 or 0 depending on the battery voltage +B in the above-described normal fuel injection control routine of FIG. 16. When the flag F is set to 1, this indicates the prohibition of normal fuel injection.

The operation of the interrupt service routine of FIG. 17 will be described hereinbelow.

(1) The operation starts at the step 200. When the ignition switch 29 is turned on to start the engine 1, the voltage +B of the battery 3 is fed to the electronic control unit 2. Since the starter switch 31 of FIG. 2 is not closed immediately after the ignition switch 29 is turned on, the starter motor 32 is not energized at the very beginning. Therefore, the determination in the step 200 results in NO to execute step 210. In step 210, logic "1" is written in WI port, and then a value t1 is written as the variable CTIME in step 270. Then the fuel injection control signal $\tau 2$ is turned off in step 310 to complete a first execution of the interrupt routine through RTN.

(2) Meanwhile, the starter switch 31 is closed to cause the starter motor 32 to receive electrical power from the battery 3 to start driving the engine 1. Therefore, when the interrupt routine is started under this condition, the determination in step 200 results in YES to execute step 205 to check whether the value of the flag F is 1 or not. Since the initial value of the flag F is 1, the determination in step 205 results in YES to execute step 230 where it is checked whether WI port=1 or not. Since logic "1" has been written in the WI port in the former cycle, the value of WI port continuously assumes logic "1" unless the constant voltage Vsub, which is fed to the microcomputer 50 as its power supply, drops due to the application of load of the starter motor 32. On the other hand, when the constant voltage Vsub is below the determinatin voltage V2, the value of WI port is then logic "0".

The value of the flag F is 1 until the first determiantion (step 155 in FIG. 16) of whether normal fuel injection is to be carried out or not is performed, and thus the determination in step 205 results in YES. However, in the case that the battery 3 has sufficient capacity so that the constant voltage Vsub does not drop, the determination in step 230 results in YES to proceed to step 260 where determination of CTIME<t2 is made. Since the value of the variable CTIME has been set to t1 in step 270 of the first cycle of the execution of the interrupt routine, the determination in step 260 results in NO to execute step 310. Accordingly, the fuel injection control signal $\tau 2$ is maintained at its off state to complete the execution of this cycle through RTN.

On the contrary, if it is determined in the normal fuel injection control routine that the battery voltage +B is sufficiently high, the value of the flag F is reset to 0, and thus the determination in step 205 results in NO. As a result, the operational flow goes through steps 270 and 310 to RTN so as to turn off the fuel injection control signal $\tau 2$ in the same manner as in the above without performing asynchronous fuel injection on engine start at all. Accordingly, when the battery voltage +B is sufficiently high, only normal or main fuel injection is performed and the asynchronous fuel injection is not carried out.

(3) On the other hand, when the voltage +B of the battery 3 drastically drops as the load of the starter motor 32 is applied when the battery 3 is in poor condition, and when the constant voltage Vsub fed to the microcomputer 50 drops below the determination voltage V2, the value of the flag F is set to 1 so that the determination in step 205 results in YES, and the determination in subsequent step 230 results in NO, i.e. WI =1 is not satisfied, to proceed to step 220. In step 220, logic "1" is written in WI port, and in a subsequent step 240 it is checked again whether WI port is of logic "1" or not. Since the value of WI port is not renewed to logic "1" even though the CPU 70 writes logic "1" as long as the signal wi is of low level, the determination in step 240 results in NO so that the operational flow goes to step 310 and then to RTN as described in the above after the constant voltage Vsub drops below the determining voltage V2 and before the constant voltage Vsub exceeds another determining voltage V1. After the constant voltage Vsub exceeds the determining voltage V1 through the fluctuation of the load of the starter motor 32, the value of WI port is set to logic 1 through the execution of steps 220 and 230, and then the determination in step 240 results in YES. This operation is shown in FIG. 18. In detail, the WI port assumes low level when the signal wi turns low, and the state of the WI port returns to high level in response to the first data writing by the CPU 70 after the signal wi turns high.

(4) When the determination in step 240 results in YES, i.e. WI port=1, operational flow proceeds to step 280. In step 280, the value of the variable CTIME is set to zero under an assumption that conditions for starting asynchronous feul injection have been satisfied. After this, the operational flow proceeds to step 290 in which the variable CTIME is incremented by 1 which variable determines the amount of fuel to be injected by the asynschronous injection on engine start. In the sebsequent step 300, the fuel injection control signal $\tau 2$ is turned on so as to start asynchronous fuel injection on engine start. After the completion of step 300, the operational flow goes to RTN to terminate the execution of this interrupt routine. When the fuel injection control signal $\tau 2$ turns low, the output signal $\tau p$ from the electronic control circuit 2 becomes active to open the electromagnetic fuel injection valves 17.

(5) When the interrupt routine is executed under the above conditions, since the value of WI port is of logic "1" until the constant voltage Vsub drops below the determination voltage V2, the determination in step 230 results in YES, and then in step 260 it is checked whether the variable CTIME is less than t2 or not. The value of variable CTIME is set to 0 in step 280, and is incremented by 1 each time step 290 is executed. Therefore, the determination in step 260 results in YES until the variable CTIME reaches t2, i.e. 50 msec in this embodiment. Steps 290 and 300 follow to perform asynchronous fuel injection on engine start through fuel injection control signal $\tau 2$.

(6) When 50 msec has lapsed under this condition, then the determination in step 260 of CTIME t2 ? results in NO so that the operational flow goes via step 310 to RTN to terminate asynchronous fuel injection. After this, the battery voltage +B fluctuates as the starter motor 32 rotates, and when the constant voltage Vsub drops below the determination voltage V2 again and then rises above the higher determination voltage V1, the processing is repeated again from the above-mentioned (3).

(7) The above-mentioned control is continued until the battery voltage +B becomes sufficiently high as the result of self rotation of the engine 1 after ignition takes place so that the value of the flag F assumes 0 and the constant voltage Vsub never drops below the determination voltage V2, or until the starter motor 32 is turned off.

Figure 18:
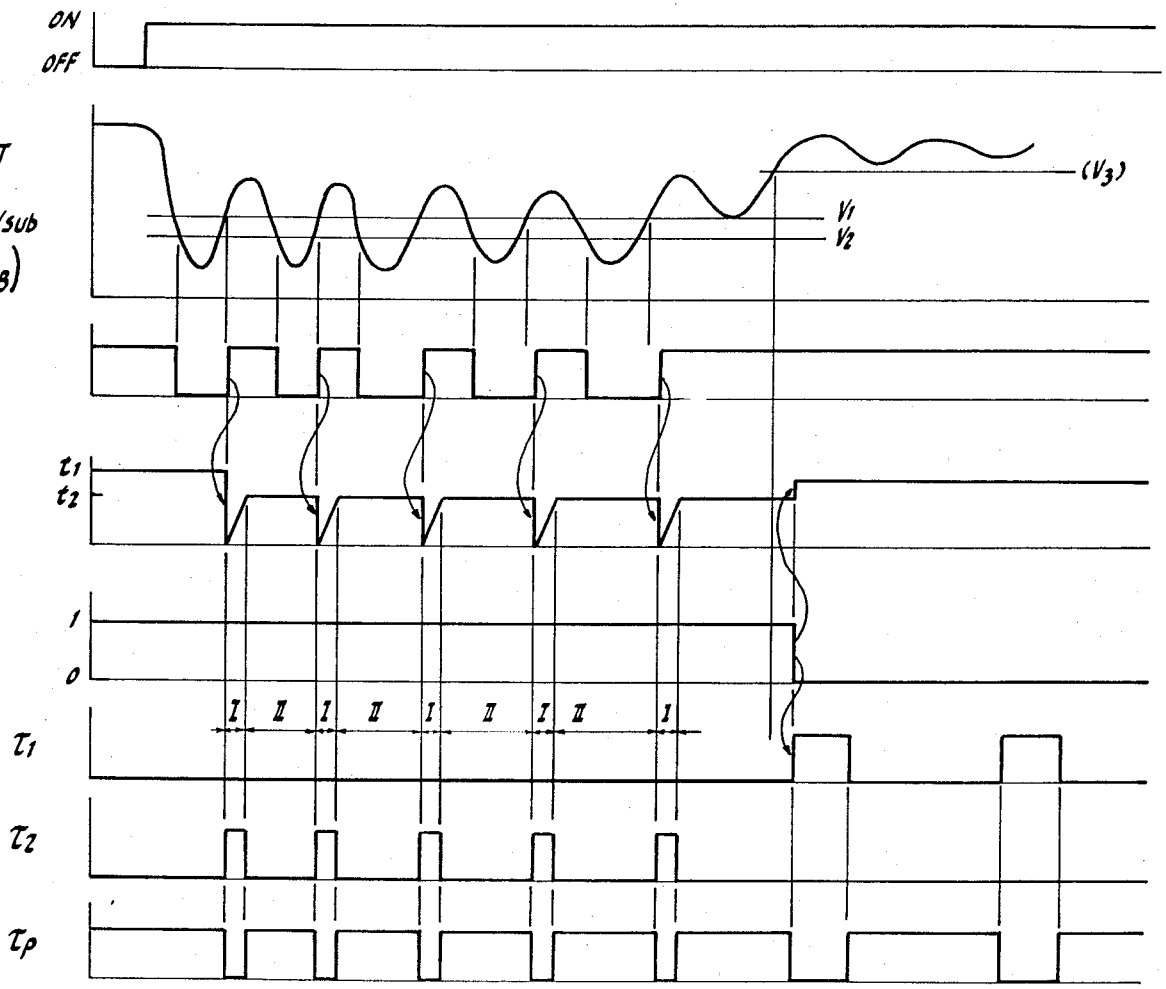
FIG. 18 is a waveform chart useful for understanding the operation of the third embodiment.

FIG. 18 is a timing chart showing an example of fuel injection control performed on engine start which is performed by repeatedly executing the interrupt routine of FIG. 17. In detail, the asynchronous fuel injection on engine start is performed (see period I in FIG. 18) using the value of the variable CTIME as a count of a counter when the constant voltage Vsub goes beyond the determination voltage V1 after it drops below the determination voltage V2 under a condition where the battery voltage +B is below the predetermined voltage V3, and is terminated when the variable CTIME equals t2 (see period II). Normal fuel injection is prohibited at this time. On the other hand, normal fuel injection is carried out when the power supply voltage of the electronic control unit 2 is established with the battery voltage +B becoming above the predetermined voltage V3, through normal fuel injection control (see period III).

In the above-described third embodiment, the state of the constant voltage Vsub, which is power supply voltage fed to the CPU 70, is watched by the wi signal outputting portion 95 when the battery voltage +B drops below the predetermined voltage V3, and when Vsub rises above a voltage, i.e. the determination voltae V1, where no problem occurs in connection with the resumption of the operation of the CPU 70, asynchronsou fuel injection of pulse width of 50 msec, which is inherent in engine start, is performed. Therefore, even if the constant voltage Vsub varies so that it assumes a low voltage with which the normal operation of the CPU 70 cannot be ensured, when the constant voltage Vsub exceeds the determination voltage V1, the asynchrnous fuel injection on engine start is immediately started. As a result, fuel injection is accurately performed on engine start so that air-fuel mixture is securely sucked into engine cylinders to enhance starting characteristic of the engine 1.

Even if the constant voltage Vsub drops below the determination voltage V2 so that the $\overline{init}$ signal is produced by the power circuit 60 to reset the microcomputer 50, when the constant voltage is restored to be higher than the determination voltage V1, asynchronous fuel injection on engine start is executed using the fuel injection control singal $\tau 2$ without waiting for the normal or main fuel injection which is carried out with fuel injection duration being computed using the rotational speed Ne of the engine 1 and other parameters. Therefore, fuel is securely sucked into engine cylinders.

Moreover, when the asynchronous fuel injection on engine start is carried out, the normal or main fuel injection is prohibited, and therefore, excessive fuel supply due to simultaneous fuel injection by both types of fuel injections can be effectively prevented. This is achieved since each of normal fuel injection and asynchronous fuel injection is exclusively performed using the flag F. As a result, only necessary amount of fuel is supplied to the engine on engine start.

From the foregoing description it will be understood that fuel injection is accurately performed on engine start without using conventional start injectors or an additional fuel supply system so that desirable starting characteristic of an internal combustion engine is ensured according to the present invention. The above-described embodiments are just examples of the present invention, and therefore, it will be apparent for those skilled in the art that many modifications and variations may be made without departing from the scope of the present invention.

What is claimed is:

1. An electronically-controlled fuel injection system for an internal combustion engine, comprising:

(a) means for detecting operating conditions of said engine;

(b) means for injecting fuel into said engine when activated;

(c) controlling means, supplied with a supply voltage, for controlling said injecting means, said controlling means initiating, during normal operation of said engine, activation of said injecting menas in relation to a rotational position of said engine and maintaining said activation of said injecting means during a time period calculated in accordance with the operating conditions of said engine detected by said detecting means; and (d) means for monitoring the supply voltage and producing first and second outputs indicating respectively that the monitored supply voltage is below and above a predetermined level corresponding to a lowest possible voltage for the operation of said controlling means;

said controlling means initiating, during cranking of said engine, activation of said injecting means each time said output condition of said monitoring means changes from said first to said second output and maintaining activation of said injecting means during a predetermined time period.

2. A system as claimed in claim 1, wherein said controlling means includes means for delaying the operation of said injecting means for a predetermined delay period in response to the output change of said monitoring means and said predetermined time period is determined in accordance with a temperature of said engine.

3. A system as claimed in claim 1, wherein said controlling means includes:

means for accumulating a time period of activation of said injecting means; and means for disabling activation of said injecting means when the accumulated time period reaches a predetermined value.

4. A system as claimed in claim 3, wherein said accumulating means comprises temporary storage means for accumulating storing number of activations of said injecting means as the time period of activations of said injecting means, and said controlling means includes means for disabling changing storage contents of said storage means when the output condition of said monitoring means changes from the second to first output so that the stored number of activations of said injecting means is maintained.

5. A system as claimed in claim 1, further comprising:

means for monitoring said supply voltage and producing third and fourth outputs indicating that the monitored supply voltage is below and above a second predetermined level higher than said predetermined level corresponding to the lowest voltage, and wherein said controlling means includes means for enabling and disabling initiation of activation of said injecting means in relation to the rotational position of said engine and in response to the output change from said first to second output, respectively, when said latter monitoring means produces the fourth output.

* * * * *